United States Patent [19]

Ferraro

[11] 3,954,403

[45] May 4, 1976

[54] REMOVAL OF PHOSPHATES IN DRAIN LINE OF LAUNDRY TUB BY CHEMICAL PRECIPITATION

[75] Inventor: Joseph George Ferraro, Wyckoff, N.J.

[73] Assignee: Colgate-Palmolive Company, New York, N.Y.

[22] Filed: Oct. 1, 1973

[21] Appl. No.: 402,534

Related U.S. Application Data

[62] Division of Ser. No. 152,312, June 11, 1971, Pat. No. 3,772,901.

[52] U.S. Cl. ..... 8/137; 8/158; 68/208; 68/18 F; 210/42 R

[51] Int. Cl.[2] ..... D06F 39/02

[58] Field of Search ..... 8/137, 158; 210/42

[56] References Cited

UNITED STATES PATENTS

| | | | |
|---|---|---|---|
| 2,733,120 | 1/1956 | Robson | 8/137 |
| 2,753,241 | 7/1956 | MacMahon | 8/137 |
| 3,023,132 | 2/1962 | Diamond et al. | 8/137 |
| 3,192,155 | 6/1965 | Bready et al. | 8/137 |
| 3,650,686 | 3/1972 | Hudson | 210/42 |

*Primary Examiner*—Donald Levy
*Attorney, Agent, or Firm*—Kenneth A. Koch; Murray M. Grill; Herbert S. Sylvester

[57] ABSTRACT

A washing machine or dishwasher includes means for admixing with waste wash water a suitable chemical compound to convert the soluble phosphate in the wash water to insoluble form before discharge of the waste solution to a sewer, drain or other means of disposal. Among the useful chemical compounds employed are calcium chloride, calcium hydroxide and aluminum sulfate, which convert soluble phosphates, including tripolyphosphate and pyrophosphate salts, to insoluble materials, which may be removed from the effluent. Also within the invention are accessories for use with conventional washing apparatuses for effecting the insolubilization reaction, and corresponding processes.

5 Claims, 10 Drawing Figures

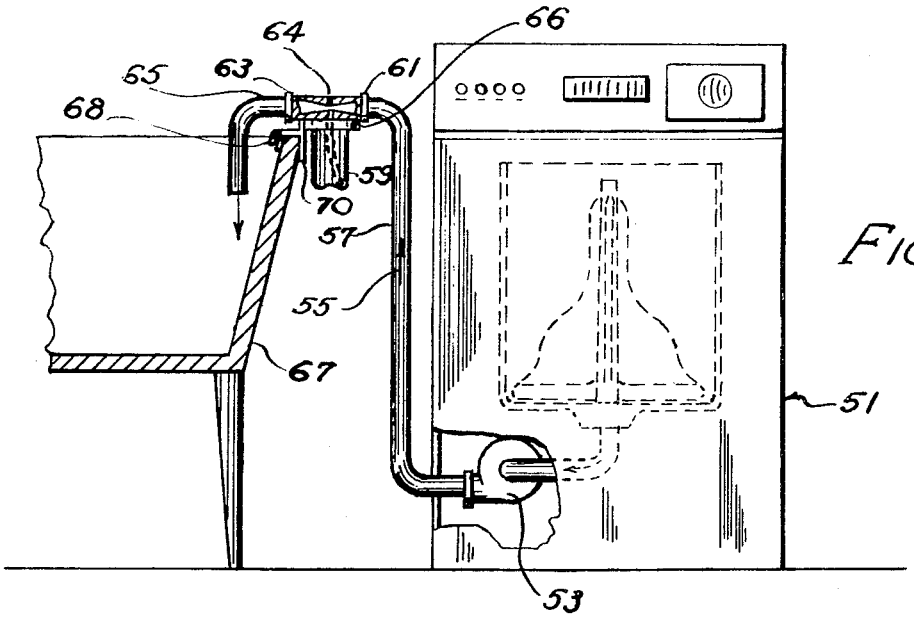
FIG. 3
FIG. 4
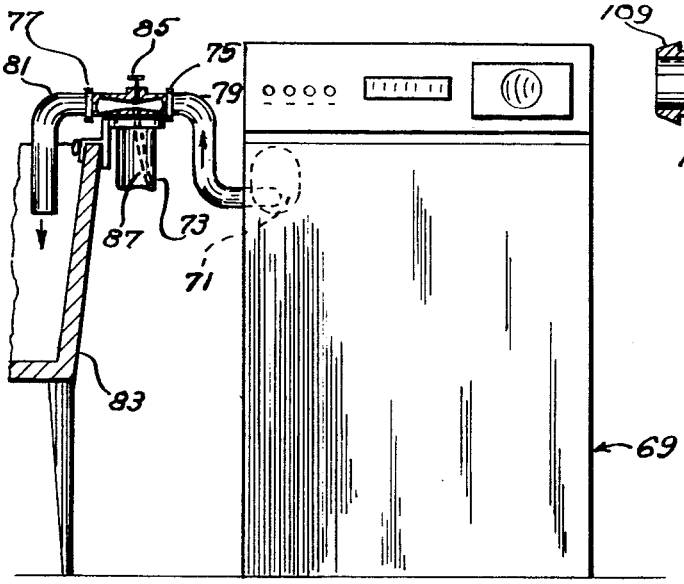
FIG. 5
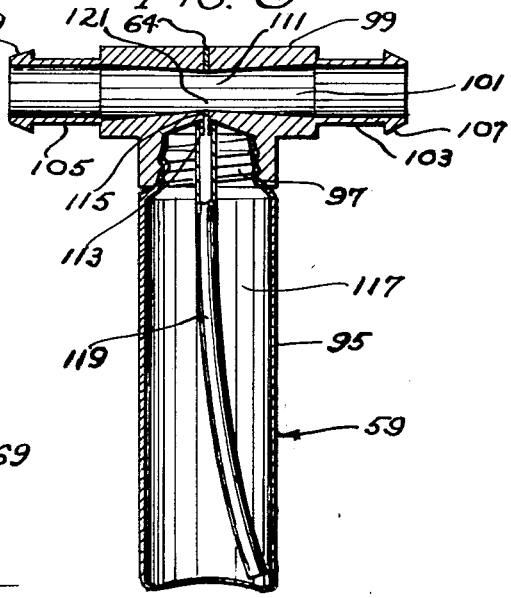
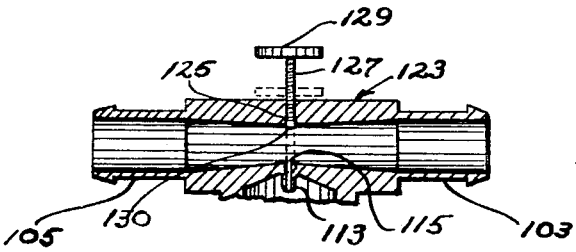
FIG. 6

FIG. 7
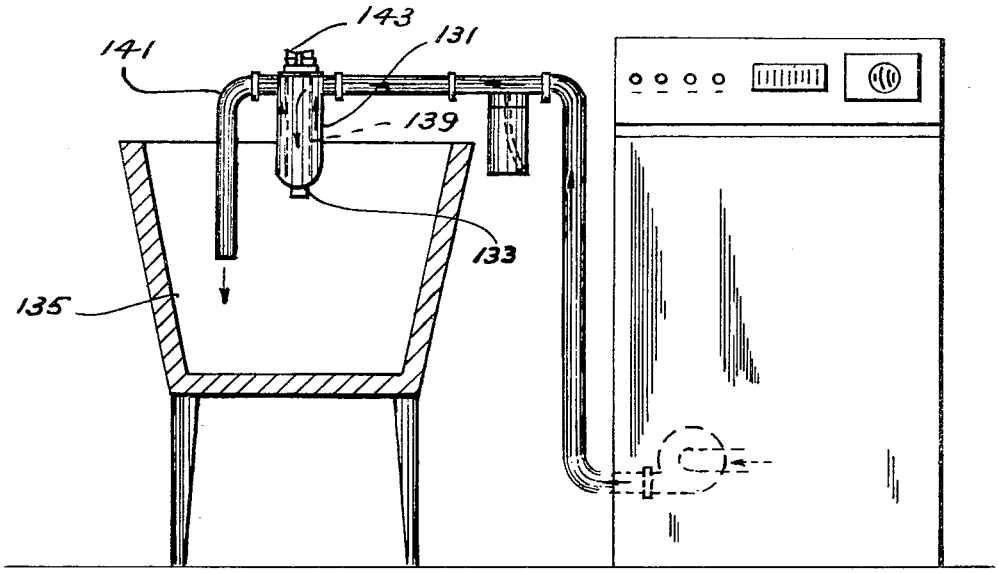
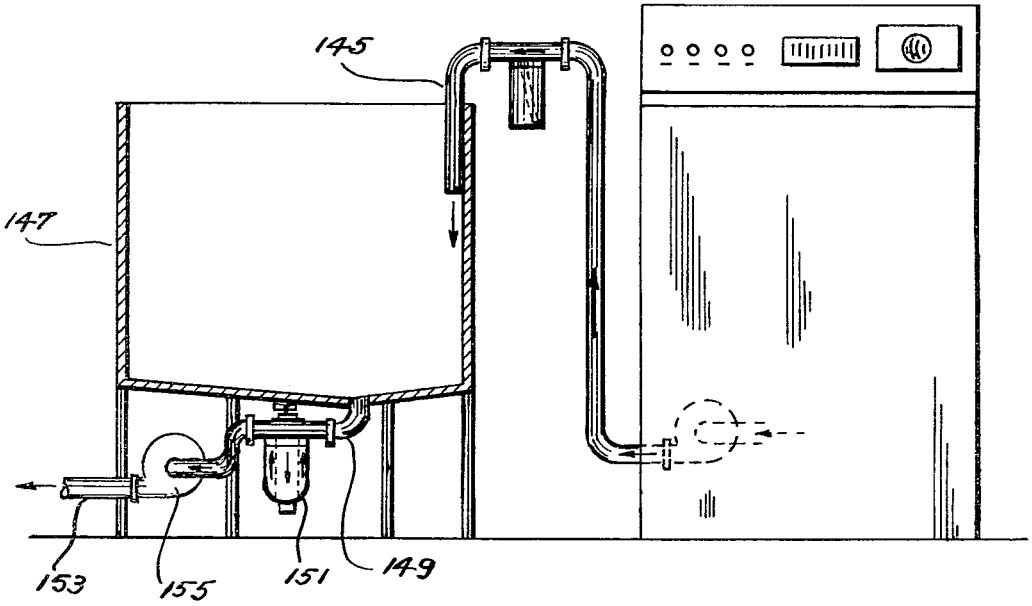
FIG. 8

REMOVAL OF PHOSPHATES IN DRAIN LINE OF LAUNDRY TUB BY CHEMICAL PRECIPITATION

This is a divisional of application Ser. No. 152,312 filed June 11, 1971, now U.S. Pat. No. 3,772,901.

This invention relates to washing apparatuses, including automatic washing machines and dishwashers, accessories for such apparatuses and methods for washing which include means and operations for removal of phosphates from the washing solution. By use of such apparatuses, accessories and processes it becomes possible for persons operating home washing machines or dishwashers to continue to employ phosphate-containing detergents of best cleaning characteristics and to treat effluents to comply with regulations relating to phosphate discharges into sewers or ground waters.

Because of allegations that eutrophication of lakes and other inland waters is contributed to by the presence of phosphate discharges from washing machines and dishwashers efforts have been made to formulate laundry detergents and dishwashing compounds, also referred to herein as detergents, without phosphor is-containing builders and cleaning agents. Such attempts have been generally unsuccessful because poorer cleaning results. In some cases the substitute materials employed have been found to be unsafe and even in those instances where the phosphate replacements are seemingly innocuous, doubts have been expressed as to their ultimate effects on the ecology if they should be discharged in greatly increased quantities.

In addition to removing of phosphates from washing compositions it has been suggested that municipal sewage treatment plants be improved so as to be able to remove phosphates, nitrogen compounds and other nutrients from waste waters and sewage being processed. This involves treatment of all waters and materials sent through the plant and particularly in those systems wherein storm water sewers and sanitary sewers are interconnected, the volumes of liquid to be treated may be so great as to make the treatment impractical. Additionally, the constructions of larger sewage disposal plants will take appreciable time, during which phosphate-containing effluents will continue to be discharged into the lakes or, in the case of bans on detergents containing phosphates, the consumer will have to use detergents which do not wash as clean as those formulated with phosphates.

The present invention provides an inexpensive treatment for phosphate-containing waste waters from washing apparatuses. Embodiments of the invention are readily added to existing washing apparatuses or may be incorporated in the construction of new machines. They can be used and operated by the housewife or homeowner. They require no difficult maintenance and capital investment costs are very small. Their use decreases the load on sewage treatment plants because the phosphates from washing operations are either removed or insolubilized. Also of great importance is the fact that the present process may be effected now, without the necessity for waiting for the construction of improved water treatment plants.

In accordance with the present invention a washing apparatus comprises means for holding items to be washed and a washing solution containing a soluble phosphate compound, means for moving the washing solution relative to the items to be washed, and into and out of contact with them until they are washed, means for removing the washing solution, containing soluble phosphate, from the washed items, and means for admixing a suitable chemical compound with the soluble phosphate in the removed solution before discharge thereof to a sewer, drain or other means of disposal, so as to convert the soluble phosphate to insoluble form before disposal of the used washing solution. In preferred embodiments of the invention the suitable chemical compound is a compound of calcium, aluminum or iron and is added to or is otherwise contacted in stoichiometric quantity or in excess by the wash water being discharged, after which the insoluble product formed, containing the phosphate, is removed, e.g., by filtration. In another aspect of the invention, an accessory, including means for reacting or contacting the reactive chemical with the phosphate-containing wash water, is fastened onto the washing machine or a discharge line from it. Also, within the invention are processes for chemically insolubilizing the soluble phosphates and filtering off the product at a location near the washing machine or dishwasher before the waste waters are sent to a sewer, drain or other means of disposal.

Treatments of wash water in conjunction with automatic washing machines or dishwashers have been effected in the past. However, most of such treatments involved softening the water or adjusting its pH prior to use, so as to avoid the precipitation of lime soaps or other insoluble products in the washing solution, which products would otherwise deposit on the materials being washed, giving them objectionable films or causing a graying thereof. In other cases, wash waters have been treated to remove dirt and suspended materials and then have been reused. In such processes, the still useful phosphate and organic detergent present are maintained in a soluble condition. In factories wherein phosphate solutions are employed, as in metal treating operations, or in commercial installations where they are employed in cleaning compositions, effluents have been collected and treated. In the treatments of detergent compositions an object has been to remove the non-biodegradable organic detergent but incidentally some phosphate would also be taken out of the waste wash water stream. Although much work has been done in the treatment of wastes and in the recovery of useful washing materials from washing machine discharges, before the present invention there was never provided a simple, convenient, compact, inexpensive and effective unit for removing phosphates from home laundry and dishwasher effluents which could be operated as a part of or in conjunction with the home washing machine or dishwasher and which would be locatable conveniently near such appliance.

In addition to the advantages of this invention previously mentioned, other desirable effects attend its use. Thus, in removing the phosphate from the waste water, most of the organic detergent, including higher fatty acid soaps, organic waste (from dishwashers), dirt and oils or greases in the wash water is insolubilized or occluded by the insoluble phosphate and is also removed. In some cases these help to improve the form of the phosphate precipitate so as to make it more readily filtered and less apt to seal off or plug a filtering element, cloth, paper, cartridge or cake. Because of the accessibility to the washing apparatus the user may readily observe when the treating chemical is consumed and may refill the container at such time. Also, by observing the filtrate he can tell when the filtering element needs attention. The effects of large scale use of the present invention will be phenomenal. In the United States alone, it has been estimated that there are about 50 million automatic washing machines in home use and more than 10 million dishwashing machines. Almost a trillion gallons of wash and rinse waters pass through these machines annually. About six billion pounds of detergents are sold annually in the United States and if, on the average, such detergents contain about 20% of pentasodium tripolyphosphate or tetrasodium pyrophosphate or other phosphate compounds, over a billion pounds of such phosphates are discharged from washing machines and dishwashers. It is estimated that if all households utilizing washing machines and dishwashers were equipped with the devices of the present invention, the discharge of such phosphates, in soluble form, can be held to less than 25% and with the best installations of the invented apparatuses and accessories this can be reduced to less than 5% in either soluble or insoluble form. Thus, by the removal of an ounce or two of phosphate per wash by each home owner, "phosphate enrichment" of island waters due to home laundering and dishwashing can be virtually eliminated.

Various objects, structures, details and operations of the invention will be apparent from the following description thereof, taken in conjunction with the drawing in which:

FIG. 3 is a partially sectioned front elevational view of such a washing machine with means for automatically adding reactive chemical to the waste wash water before discharge to a wash tub;

FIG. 4 is a partially sectioned front elevational view of a similar machine equipped with a water saver and a modified means for adding reactive chemical to the waste water upon ultimate discharge;

FIG. 5 is an enlarged vertical sectional view of the chemical additive means of FIG. 3;

FIG. 6 is an enlarged vertical sectional view of a portion of the modified chemical additive means of FIG. 4, illustrating a means of shutting off the additive feed, when desired;

FIG. 7 is a partially sectioned front elevational view of a washing apparatus of the invention, equipped with both chemical additive and filtering means;

FIG. 8 is a partially sectioned front elevational view of an apparatus of the invention comprising means for adding reactive chemical, a settling tank and a filter after the settling tank;

Figure 1:
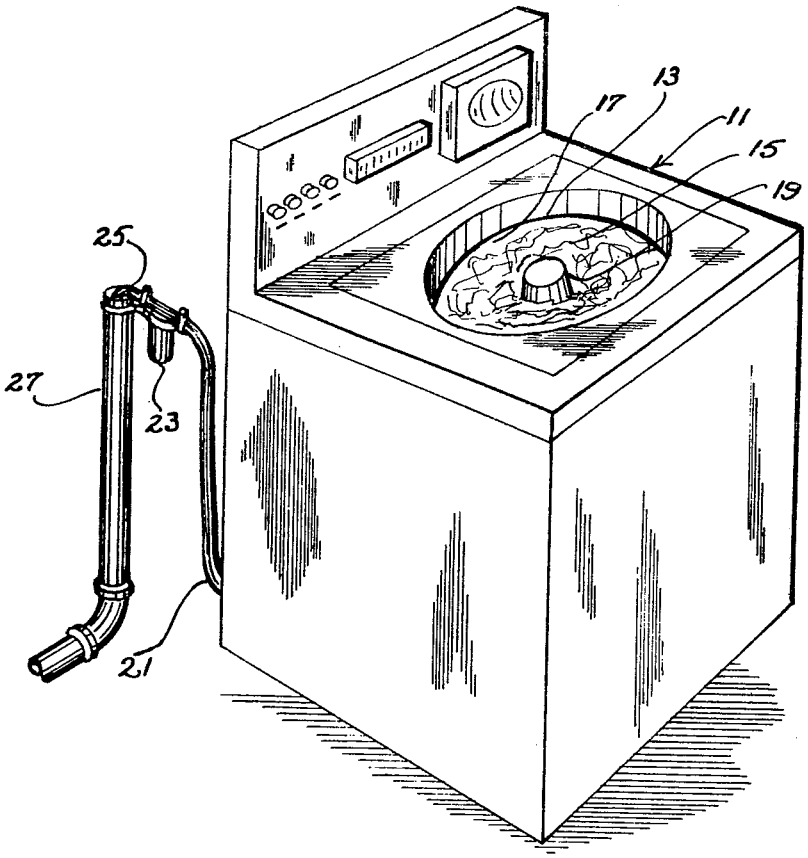
FIG. 1 is a front perspective view of a washing apparatus of the invention discharging into a standpipe.

Referring to FIG. 1, an automatic washing machine 11 includes tub means 13 for holding items to be washed 15 and washing solution 17 plus agitator means 19 for moving the washing solution relative to the items to be washed and into and out of contact with them until they are washed. Outlet hose 21 contains a passageway for removing the waste wash water. It is joined to a dispensing means 23 for adding or admixing a suitable chemical compound, such as a reactive chemical to precipitate phosphate out of the waste wash water. After leaving the admixing or reaction means 23, the wash water, now containing insoluble phosphate instead of soluble phosphate, passes through discharge hose portion 25 into standpipe 27, from which it is drained to a sewer, drain or other disposal means.

Figure 2:
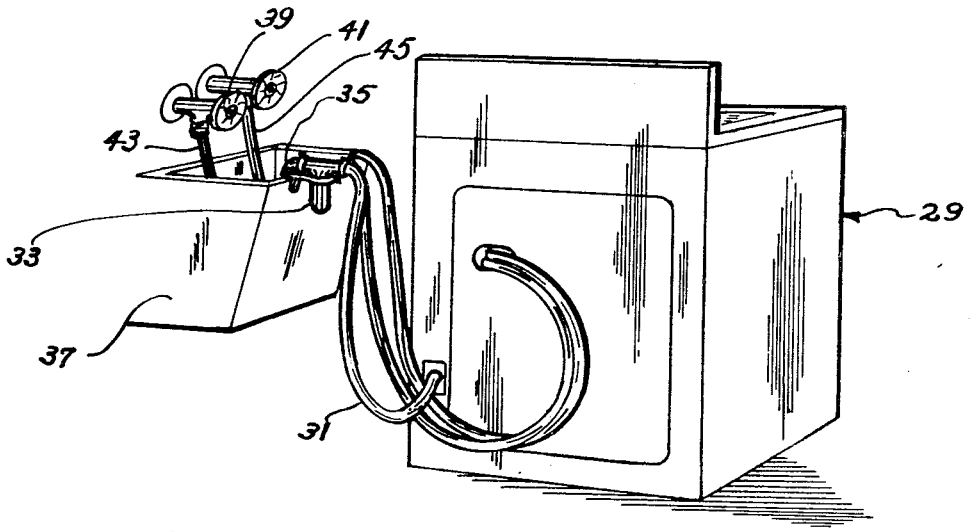
FIG. 2 is a rear perspective of such machine, showing inlet water connections and discharge to a laundry tub.

In FIG. 2 is shown a similar automatic washing machine 29. In this view, discharge hose 31, together with reactive chemical admixing means 33 and discharge hose portion 35, empties waste water into a laundry or wash tub 37, from which it is drained to a sewer or other disposal means. The wash tub may be closed off by a stopper, not shown, to provide additional flocculation or agglomeration time for the insoluble phosphate precipitate, before it is sewered. Alternatively, the insoluble phosphate, in aqueous wash water medium, may be sent directly to the sewer. Also, illustrated in this view are hot and cold water taps 39 and 41, and corresponding water inlet hoses 43 and 45. Power is obtained from receptacle through an insulated lead wire, not shown. Timers, switches, solenoid valves, motors, pulleys, belts, gears, pumps, supports, framing, pipes, hoses, clamps and various other elements of the washing machine are conventional or are only slightly modified and therefore, for the sake of clarity of exposition of the main features of the present invention, are not illustrated in FIG.'S. 1 and 2.

In FIG. 3 there is shown an embodiment of the present washing apparatus, including a washing machine 51 having a discharge pump 53 which, at the appropriate time in the washing cycle after completion of the washing of laundry, forces the consumed wash water 55 out of the tub of the washing machine, through discharge piping 57, past one form of chemical admixing means 59, clamped or otherwise held to the piping at 61 and similarly clamped at 63, to additional discharge piping 65, through which the treated waste wash water is discharged into tub 67, from which it is sewered. The admixing accessory 59 is held by an adjustable collar 66 which is fastened to a mounting means 70 held by thumb-screw 68 to tub 67. Plug 64 closes a valve stem passageway, which is not in use. Such a valve will be discussed with respect to the descriptions of FIG.'S. 4–6. Details of structure of the illustrated automatic reagent adding mechanism 59 will be given subsequently in a description of FIG. 5.

FIG. 4 illustrates an apparatus of this invention employed in conjunction with a water saver type of washing machine. In this embodiment of the invention, washing machine 69, equipped with a discharge pump, not shown, and a two-way valve 71, of conventional design and operated electrically by means of a timer, permits the saving of wash water, generally employed for washing lightly soiled white wash, for subsequent washing of more heavily soiled laundry. By means of such a water saver, detergent is conserved and less phosphate carrying washing composition needs to be employed. Reagent additive means 73 is fastened by clamps 75 and 77 to portions of discharge piping 79 and 81 and functions in manner similar to that for additive means 59, illustrated in FIG. 3, with one major exception. Because the outlet line is utilized for both temporary and final discharges of wash water to wash tub 83, means 85 is provided to prevent reagent solution 87 from being fed into the discharging wash water passing through lines 79 and 81 when the water is to be used again. If this were not done the insoluble phosphate produced would adhere to the laundry and, of course, the washing or building power of the soluble phosphate would be lost. Shut-off means 85 will be described more fully with respect to FIG. 6. In operation, valve stem 85 is depressed, preventing reactive chemical solution 87 from being fed into the discharge waste water when it is intended for that water to be subsequently fed back to washer 69 through a return line, not illustrated. After re-use of the washing solution, a stopper is removed from the wash tub, valve stem 8, is lifted, allowing solution or aqueous dispersion of treating chemical to feed into the waste water passing through the discharge line, because of suction generated in the Venturi, and the waste water is treated with a calcium, aluminum, iron or other suitable salt or compound or mixture thereof to produce an insoluble form of the phosphate, which is drained to a sewer or other means of disposal. If desired, of course, the stopper may be left in place until the treated waste water is all in wash tub 83, wherein it may be allowed to settle and agglomerate, after which it is dischargeable through the drain by removal of the stopper. Alternatively, in the devices described, the insoluble phosphate may be removed from the material being sewered, by filtration or other separatory techniques, which will be illustrated in more detail with respect to other figures of the drawing. In the description of FIG. 4, the two-way valve in the washing machine is operated electrically and the shut-off valve for chemical reagent is operated manually. Of course, both valves may be manual or both electrical or the two-way valve may be manual and the shut-off valve for additive feed may be electrically controlled.

Automatic reactive chemical admixing means 59, illustrated in conjunction with the apparatus of FIG. 3, is shown in detail in FIG. 5. Plastic or glass or other suitable container 95 has a threaded neck 97 onto which is fastened a threaded molded head portion 99, desirably made of a suitable plastic, e.g., nylon, phenol formaldehyde or polyacrylate. Molded into the head is a major passageway portion 101, having ends 103 and 105 flanged at 107 and 109 to facilitate clamping or threaded attachment to inlet and outlet hoses, through which the wash water will pass. Between the passageway ends is a Venturi section 111, at the throat of which is an aspiration tip 113, through a narrow passageway 115 of which a solution 117 of reactive chemical is drawn through dip tube 119, to be mixed into and reacted with the phosphate in the wash water at the Venturi throat 121. The dip tube, usually of resilient plastic, e.g., polyethylene, polypropylene, polyvinyl chloride, is usually press fitted onto the aspiration tip of the dispenser head, although in some applications it may be possible to mold it unitarily with the head. The operation of the dispenser is essentially automatic, since the flowing of wash water creates a vacuum at the throat of the Venturi and draws a desired amount of reactive chemical into the throat to mix and react with the wash water. Although not illustrated in FIG. 5, in some embodiments of the invention the dip tube or the aspiration throat may be modified or adjusted in effective passageway size so as to adjust the proportions of reactive chemical solution to be mixed with the wash water. Otherwise, to obtain such an adjustment, different heads may be employed wherein the Venturi passageway or the aspiration passageway size is changed. In FIG. 6 is shown a means of effecting such modification of feed rate, although the valve portion there shown, which modifies the structure of the dispenser of FIG. 5, is primarily intended for shutting off flow entirely or for operating wide open. In the modified dispensing head illustrated, Venturi portion 123 includes a passage 125 in which is located a valve stem 127 having a handle portion 129 and a mushroom-shaped end 130. By moving the valve handle downwardly the end 130 blocks aspiration passageway 115 and prevents any treating chemical from being drawn into the Venturi throat. Of course, means such as threading of the valve stem, a toggle mechanism or frictional engagement will be provided to hold the valve in open or tightly closed position. By a very fine adjustment of the closing off of aspiration passageway 115 a measure of control of the flow rate of the treating chemical is obtainable.

In FIG'S. 7, 8 and 9 the washing machine, discharge pump and inlet line sections of the apparatuses are essentially the same as those illustrated in FIG. 3 and in FIG'S. 7 and 8 the automatic dispenser for treating chemical is also like that of FIG. 3. Hence, such will not be described in detail herein. In FIG. 7, a treated wash water downstream of the admixing means, now containing insoluble phosphate, passes through filter 131, leaving the insoluble phosphate in the filter, from which it is dischargeable through outlet 133. Then, the filtered wash water is discharged into a tub 135 and from there may be sent to sewer through an outlet. If desirable, the effectiveness of the filter may be tested by allowing the water to remain in tub 135 and examining it for clarity. The filter illustrated is of the sharp edged Pur-o-lator type wherein the insolubles collect in the internal portion with the filtered fluid passing through filtering element 139, usually of perforated stainless steel or other suitable material, and out outlet line 141. Periodically the filter may be cleaned by rotating handle 143 which moves a scraping blade over the internal surface of the filter and cleans it of insoluble material, which is then removed through outlet 133. In FIG. 8 a modified design of the apparatus is illustrated in which, after adding of reagent to the waste water, the water is discharged through line 145 into settling tank 147 and after an appropriate time for agglomeration of the precipitate, the water, containing the dispersed precipitate, is allowed to pass through outlet 149, filter 151 and exit line 153, to disposal. As illustrated, pump 155 is employed to assist in pulling the fluid through filter 151.

Figure 9:
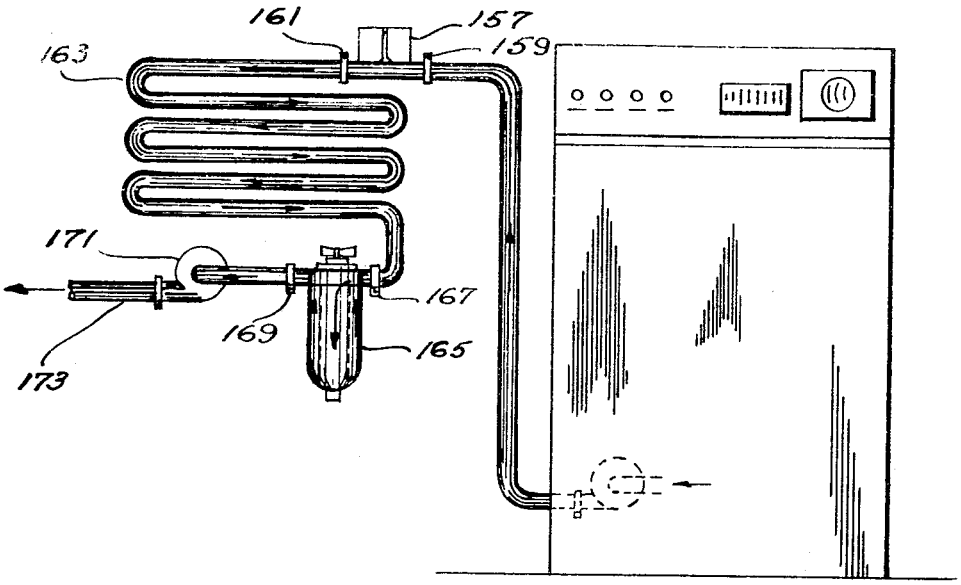
FIG. 9 is a partially sectioned front elevation of another embodiment of the invention in which the settling tank is replaced by a similarly functional holding length of piping.

In FIG. 9 chemical reagent addition means 157 is of a different design but still operates on the aspiration or Venturi principle. It is clamped to the outlet piping or is threaded onto it at 159 and 161. The solution or suspension of precipitant chemical is above the outlet to the piping but the opening or orifice of the aspiration tube is small enough so that there is no flow unless the decrease in pressure due to discharge of waste wash water through the Venturi is also obtained. After passing through the admixing means 157 the wash water, now containing suspended insoluble phosphate, enters piping coil 163, which functions as a holding area for the wash water, permitting completion of any precipitate-producing reaction and enabling the precipitate to be agglomerated so as to facilitate filtering or other separation from the water. The precipitate is filtered off at filter 165, which may be self-cleaning and which is held to the piping by clamps 167 and 169. Then it passes through pump 171 and is sent to sewer through final discharge line 173.

Figure 10:
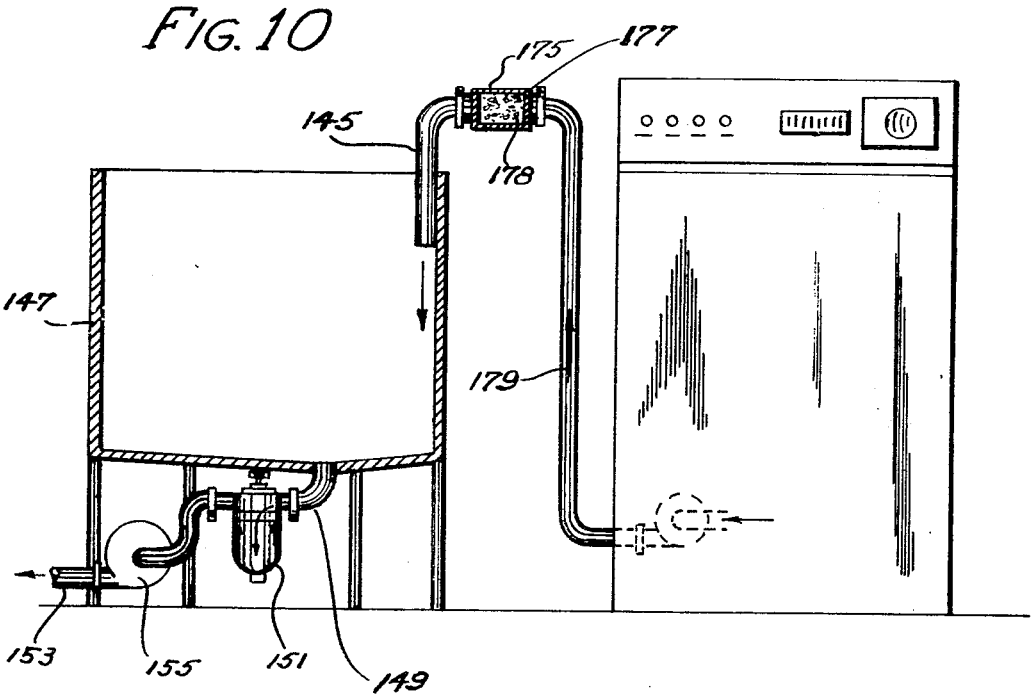
FIG. 10 is a partially sectioned front elevational view of a further embodiment of the invention in which waste wash water is passed through a treating cartridge of particulate or caked reagent.

In FIG. 10 is illustrated a treating apparatus like that of FIG. 8, with the difference that, instead of a Venturi means for admixing treating chemical with the waste wash water, a cartridge of such chemical in solid form or packed in with a passageway forming matrix, such as glass wool, polyurethane foam or a packed bed, is used. Such a chemical may be calcium hydroxide, calcium oxide, sometimes calcium carbonate, and corresponding aluminum, zinc, magnesium, iron and other such compounds, if the solubility thereof is greater than that of the corresponding phosphate or polyphosphate. Thus, cartridge 175, containing finely divided (through 100 mesh, on 325 mesh) calcium hydroxide 177 distributed through a lesser weight (10 to 50%) of glass wool 178 is reacted with phosphate-containing waste water 179, removes the phosphate from it and acts to filter out or otherwise hold most of the phosphate in the cartridge, which may be constructed so as to be disposable. Any $Ca(OH)_2$ forced through the reaction accessory may react with the phosphate in the water in tank 147 and be filtered out by filter 165.

Instead of the particular embodiments of the invention illustrated, modifications thereof may be made and the invention may be applied to other home appliances which would normally discharge water containing soluble phosphate, usually accompanied by water-soluble synthetic organic anionic detergent salt, too. Without limiting the inventive concept, it will be apparent that the phosphates discharged by a dishwashing machines may be removed, as may be those used in floor and wall scrubbing machines. The accessories of the invention may be adapted for utilization with wash tubs or other containers or passages into which phosphate-containing cleaning waters may be discharged. Thus, the accessories and the invention are applicable to removing soluble phosphates from washing solutions used to mop floors, clean walls, shampoo carpeting or hand wash clothing, as well as those for automatically washing dishes or laundry.

Along with the removal of phosphates, the present invention may remove other chemical constituents of washing solutions which are insolubilized, occluded or otherwise entrapped, adsorbed or absorbed by the inorganic compound or component employed. Thus, silicates and carbonates are removable, as are soaps, organic fluorescent brighteners, dyes and synthetic organic detergents. In some instances bactericidal or fungicidal compounds are insolubilized or otherwise carried down with the insoluble phosphates being precipitated. The water discharged, except for the presence of comparatively innocuous soluble salts of the anions of the treating chemicals, e.g., chlorides, sulfates, will have been purified of various materials utilized in the washing process and normally discharged to sewer or ground waters, from whence they might otherwise flow to inland rivers and lakes. When oxides or hydroxides are used for treatment there is no by-product or it is water, so even the minor problem of chloride, sulfate or other soluble material disposal is avoided.

The means for addition of treating chemical solution needs not be operated on the aspiration or Venturi principle. More complex systems can be employed, including a pump for the additive driven by the flow of waste water so as to proportion the addition of reactive chemical correctly, or electrically operated pumping or valve means may be utilized, timed with the washing machine cycle. Such structures are more complex and more expensive than the simple means illustrated but under some circumstances may be preferred. The treatment chemical may often be added as a liquid, in aqueous solution, but sometimes suspensions, powders, or even solid blocks, past which the waste water flows, are usefully operative. In fact, a preferred treatment is with a comparatively insoluble hydroxide (or an oxide which is convertible to the hydroxide) such as calcium hydroxide. This is used as a fine suspension in water, usually of 10 to 80% "concentration". Means may be provided for maintaining the suspension uniform (a stirrer may be used) and particle sizes can be small enough to feed through the aspirator opening.

The chemical addition means may be held in place on the washing machine, standpipe, washtub or other suitable structure and can even be located in a fixed sewer line carrying the machine discharge. The discharge line may be flexible or rigid and the installation of the chemical addition means may be permanent or temporary. Similar considerations apply to the installation of the means for removing the insoluble products resulting from chemical treatment. Instead of employing the particular filter illustrated, various other types of filters may be used, including centrifugal, cartridge, plate and frame, and diatomaceous earth bed filters. Centrifugal separators, where applicable, may be employed and in some instances, it may be desirable only to relay on sedimentation or settling out of the insoluble materials, after which they may be removed by hand, vacuum or in other suitable manner.

Although it is highly desirable to separate the insolubilized phosphate from the waste water, in some applications it may be considered unnecessary to do this and the means for removing the phosphate may be omitted, allowing discharge of the waste water containing it in insoluble form. In other cases mechanical means for automatically adding treating chemical may be considered to be an unwarranted expense and manual addition of treatment chemical may be effected, as in a washtub, and if desired, the settled out phosphate may be removed by hand. Such methods may effectively improve the quality of the discharged water but are troublesome for the consumer to use and, it is feared, would be omitted when too inconvenient. On the other hand, the present automatic addition and removal means and operations require little attention by the users of washing machines. Even less attention is required if the filtration means is equipped with an automatic or semi-automatic self-cleaning device, such as are found on various filters of this type, e.g., Pur-o-lator filters, manufactured by the Pur-o-lator Company. Even if the filters have to be cleaned periodically, this may be done only about once a week for the average household and the filter size will normally be chosen accordingly. Thus, the only appreciable effort required by the user of a washing apparatus is to clean the filter, make sure that the reactive chemical is periodically replaced and to make tests, if considered desirable, on the effluent to ascertain whether the treatment of the phosphate and/or its removal as insoluble phosphate has been completed. So that the housewife or other user of the home washing apparatus may conveniently re-fill the dispenser with reactive chemical and clean out the filter or separating means, if necessary, it is of importance that the addition and filtration means be located near the washing apparatus. Usually, if such equipment is not attached to the washing apparatus or included in its structure and accessible to the housewife, it will be located within no more than 20 feet, preferably within five or ten feet. When located within the washing apparatus cabinet, door or other access means will be provided to facilitate replacement of reactive chemical and cleaning of the filter or settling tank.

The invented methods may be applied to waste waters from the use of washing compositions containing widely varying proportions of phosphates and the phosphates may be in any of various forms. primarily, the invention is intended for the treatment of sodium tripolyphosphate and to a lesser extent tetrasodium pyrophosphate, monobasic, dibasic and tribasic sodium phosphates. However, other phosphates which may be effective additives to detergents may be employed and the various phosphates may be present as other alkali metal and soluble metal salts. When home laundry apparatus waste waters are being treated they will usually contain from ⅓ to two cupsful of detergent per 8 to 30 gallons of wash water. Such detergent, for good cleaning power, will normally comprise from about 2 to 15% of phosphorus and its density will be from about 0.2 to 1.2 grams per cubic centimeter. Thus, the phosphorus concentration in the wash water will be from about 2 to 40 grams of phosphorus per 30 to 115 liters or from about 0.003 to 0.13%. Preferably, the concentration will be from 0.01 to 0.1% of phosphorus, which corresponds to about 0.02 to 0.2% $P_2O_5$ or 0.03 to 0.3% of $PO_4^{=}$.

In addition to the phosphates utilized in washing clothing, other phosphates, principally including chlorinated phosphate diswashing agents of known types, are often employed in diswashing compositions, with or without the conventional polyphosphates or orthophosphates, previously mentioned. The concentrations of such materials approximate those given for the laundering detergent phosphates because, although lesser amounts of dishwashing composition are utilized, the water employed is also much less than is used for laundering.

The organic detergents generally employed in clothes washing include higher alkyl aryl sulfonates, principally higher linear alkyl benzene sulfonate, sodium salt; higher alkyl sulfates, principally sodium lauryl-, myristyl-, palmityl-, and stearyl sulfates; sodium higher fatty acid mono- and diglyceride sulfates; sodium higher fatty acid soaps; sodium poly-lower alkoxy ether sulfates; sodium alkyl phenoxy poly-lower alkoxy sulfates; sodium higher olefin sulfates and sulfonates; sodium n-lauroyl sarcoside; sodium higher fatty acid amides of N-methyl taurine (Igepon T type); and sodium higher fatty acid isethionates (Igepal A type). Instead of the sodium salts, other water soluble salts may be employed, including the potassium, ammonium, mono-, di- and tri-lower alkyl- and alkanolamine and magnesium salts, in suitable circumstances. Of course, care should be taken in the selection of the cations of the detergents, builders and other ingredients that they do not interfere with the washing action of the composition by reacting with the phosphates or other inorganic salts of the compositions before or during the washing operation.

With the anionic detergents, and sometimes in replacement of them, there will often be employed nonionic cleaning materials, such as the block copolymers of ethylene oxide, propylene oxide and propylene glycol (Pluronics); mixed polymers of lower alkylene oxides, e.g., ethylene oxide and propylene oxide; the alkyl phenoxy polyoxyethylene ethers; higher fatty alcohol poly-lower alkylene oxides; higher fatty acid esters of poly-lower alkylene glycols; sugar or sugar derivative alcohol esters and ethers of higher fatty acids and higher fatty alcohols; and poly-lower alkylene glycols. The polymeric materials will usually have molecular weights of from 500 to 50,000, preferably from 1,000 to 20,000. With either the anionic or nonionic detergents there may be present zwitterionic, ampholytic or amphoteric surface active compounds of the Miranol, betaine or imidazoline types, which are known in the art. Generally, the use of cationic detergents and surface active agents will be avoided, although in some applications their presence may be tolerated and even desirable. In the above descriptions, higher refers to aliphatic, preferably alkyl radicals of 10 to 18 carbon atoms, and lower refers to those of 1 to 4 carbon atoms, preferably 2 to 3.

The inorganic phosphate content of laundry detergents will usually be in the range of from 10 to 45% thereof, the greater quantities effecting better cleaning. In dishwashing formulations, which are essentially inorganic, the phosphate content will normally be from 40 to 95%. The organic detergent constituent of home laundry detergents will generally constitute from 5 to 35% thereof, preferably from 10 to 25%. The balance of the composition may include water, sometimes as water of hydration, e.g., from 1 to 15%; and various adjuvants, including foaming agents, e.g., lauric myristic diethanolamide; bactericides, e.g., trichlorocarbanilide; soil anti-redeposition agents, e.g., polyvinyl alcohol, sodium carboxymethylcellulose; fillers, e.g., sodium sulfate; coloring agents; hydrotropes; anti-foaming ingredients; lanolin derivatives, as emollients; and perfumes. Percentages of each of these materials will usually be small and the total thereof, excluding water and solvent, will generally not exceed about 10 to 20% of the composition. All figures given are on the dry basis. Of course, liquid heavy duty detergents contain substantial proportions of water, generally major proportions thereof, e.g., 60 to 80%. Although various compositions are herein described to illustrate the detergents which may be employed, it is clearly within the inventive concept that other phosphate-containing detergent materials may have the soluble phosphates thereof removed by this method.

The wash waters treated contain the dirt, grease, staining material, fatty matter, etc., removed from the materials washed and in suspended form. The amount of such materials normally will be only a small proportion of the content of detergent employed, and will be less than the soluble phosphorus content of the waste wash water. It will often be removed from the waste water by the precipitating phosphate. The treating chemical may be any material capable of reacting with the soluble phosphate to produce an insoluble compound. Thus, it is within the concept of this invention to employ suitable inorganic and organic compounds although the least expensive and most readily available useful materials are water soluble inorganic salts and other compounds such as oxides and hydroxides which, although not very soluble, (not soluble to the extent of over 100 g./l. at 10 to 20°C.), form less soluble phosphates. The salts are preferably those of inexpensive strong acids, such as sulfuric acid and hydrochloric acid but other soluble salts, including bromides, nitrates, sulfites, acetates, propionates, and similar materials may be used The cations of the treating compounds are usually calcium, aluminum or iron but other cations which form insoluble phosphates, including barium, magnesium and copper are also useful, as are those of other metals and radicals which perform a similar function but are usually more expensive or less readily available. Of course, the treating chemical should not react preferentially with a detergent ingredient other than the phosphates. Preferably, the treating chemical will be calcium hydroxide, calcium oxide, calcium chloride, calcium carbonate, aluminum chloride, aluminum sulfate, alum, ferric chloride, ferrous chloride or any suitable mixture thereof. Calcium sulfate will rarely be employed, because of its relatively poor solubility. The concentration of treating chemical in aqueous solution or dispersion will normally be as high as feasible, generally from 2 to 80% and preferably from 30 to 70%, so that the volume of liquid to be added will not be overly great, requiring a larger container and more installation space. It is preferred that the quantity of such liquid employed should be relatively small, compared to the waste wash water being treated. From about 50 to 1,000 milliliters will usually be used per 60 liters of wash water and the content of reactive chemical will be from about a stoichiometric equivalent to 200% in excess of such equivalent. Preferably, an excess will be employed which will be from 20 to 100%. Of course, when employing packed cartridges or solid treating agents greater excesses may be used because the material is available for treating subsequent waste wash water discharges.

In the event that an ion exchange agent or reactive bed of treatment chemical, e.g., anion exchange agent, calcium hydroxide or iron oxide, is to be employed, it will not be necessary for the treating chemical to be as soluble as described above. In such cases, it is only important that phosphate be taken up by the chemical and thereby be insolubilized. With ion exchange agents there are certain disadvantages. The ion exchange agents release other ions to the waste water, which may be less acceptable than the chlorides, sulfates and water of the present processes, and often require rejuvenation, which releases the phosphate in soluble form again, creating a disposal problem. In accordance with the present invention disposal may be effected by drying a filter cake or other means for collecting insoluble phosphate material and collecting such cakes for burial or burning off of organic material, followed by industrial use of the insoluble phosphate material. With ion exchange agents, one is left with a dilute aqueous solution of the phosphate, which would require evaporation off of the moisture before the unwanted phosphate could be disposed of. Such a treatment is usually much less efficient for removing phosphate from waste wash waters than those previously described. Evaporation of the waste waters and disposal of the phosphate, although possible, would be economically disadvantageous, compared to the preferred methods of the invention described above.

The chemical reactions to produce the insoluble phosphates may be effected almost instantaneously. Yet, under some circumstances, it may be desired to hold the reactive chemical with the soluble phosphate material for a comparatively long period of time to make sure that the reaction has gone to completion or that the insoluble product is in desired form to be separated from the accompanying liquid. The reaction may take place in as little as 1/10 of a second or less or as long as five hours but generally will be complete within from one second to one hour. Under such conditions, the flow rate of the wash water may be comparatively great, e.g., from 1 to 100 gallons per minute, usually from 10 to 40 p.p.m. Such a flow rate may create a vacuum in the aspiration tube of about 3 inches to 2 feet of water and cause a flow through such tube, which may be restricted to adjust the flow rate, such that the contents of the container of treating chemical will be admixed with the waste water during all of the time of passing of the waste water through the Venturi. Such period will usually be from about 20 seconds to three minutes and will generally be about a minute or two.

The phosphate produced, including polyphosphate or similar compound, will be of a solubility such that most of it will be undissolved in the quantity of wash water employed. Under usual operations at least 75% of the soluble phosphate present in the waste water will be removable as insoluble phosphate and under ideal conditions this may be 90% or more, up to almost 100%. The solubility of the phosphate will preferably be such that less than 10, preferably less than 5 parts per million of phosphorus will be present as soluble phosphate or similar compound in the wash water being discharged. To obtain the best quality of water being discharged, pH adjustment of the wash water may be effected, if necessary or desirable, usually by addition of a non-phosphate buffering agent or an acid or base to the treating chemical solution, so that the pH is in the range of 5 to 12. For precipitation of aluminum phosphates by the treatment of waters containing sodium tripolyphosphate, it is preferred that the pH should be in the range of 5 to 8 and for the precipitation of calcium phosphates this may be from 8 to 12. Fortunately, because most built synthetic organic laundry detergents make solution of pH's of about 8 to 10.7 at washing concentrations and the treating chemicals may help to adjust pH's, little additional pH control is necessary, but with other preparations, such as dishwashing compounds, acid or acid side buffers, e.g., citric acid, sodium acetate, may be employed to lower the very high pH's of such solutions. The temperature at which treatment is effected may be automatically controlled by heat exchanger means but will usually be that at which the wash water is discharged or to which it is cooled during holding in a tank or tub. Generally, useful phosphate removal is obtained at 10° to 90° C., preferably 15 to 80° C. and most usually at 20 to 65° C.

Concentrations of reactant chemicals are of importance to obtain best phosphate removal. In the washing machine the phosphates are present in an excess with respect to water hardness ions and do not precipitate out objectionably. With the present treatments enough additional "hardness" is added to reverse the excess relationship and remove the phosphates. For example, if 15 gallons of wash water contain 150 p.p.m. of hardness, as $CaCO_3$, and 1 cup of 35% $Na_5P_3O_{10}$ built synthetic organic detergent, there are present about 9 grams of hardness, as $CaCO_3$ and 35 grams of $Na_5P_3O_{10}$. After addition of about 1 pint of a 40% $CaCl_2$ solution by the treating accessory the final waste wash water contains about 200 grams equivalent of $CaCO_3$, a substantial excess. If calcium hydroxide is used much of the excess may be filtered out with the phosphate, resulting in little material added to the waste water discharged. However, even if soluble salts are used and the excess is not removed the treating chemical discharged to the sewer may be useful because it can help to decrease the amount of additives needed at a sewage treatment plant.

The operation of the invention and the various advantages thereof are considered to be clear from the foregoing description and the following illustrative examples. All parts are by weight and all temperatures are in °C. unless otherwise indicated.

EXAMPLE 1

One and ¼ cups (10 ounces) of a heavy duty spray dried commercial detergent powder, containing approximately 35% sodium tripolyphosphate, 8% sodium silicate of a $Na_2O:SiO_2$ ratio of about 1:2, 25% of sodium higher linear alkyl (12 to 15 carbon atoms) benzene sulfonate, 15% of sodium sulfate, 5% of water and about 10% of adjuvants and other minor constituents, including optical brightener and soil dispersant, are added to the tub of a top loading automatic washing machine containing about nine pounds of a mixed batch of soiled clothing and about 17 gallons of water, at 70° C. The detergent concentration in the washing machine at such a charge is about 0.15%. The pH is about 9.5 and decreases to about 8.5 as the clothing is washed and the soil on it is removed. Agitation is effected automatically, using a vertical agitator of conventional design for moving the wash water into and out of contact with the laundry. Instead of such an agitator, a corresponding spray-, spinning surface impact-, vibrator-, tumbler- or pump- means may be employed to create the desired wash water circulation. At the completion of the washing operation, which takes about 30 to 60 minutes, waste wash water is discharged from the washing machine by the opening of a valve and the actuation of a discharge pump in the machine. Utilizing apparatus like that of FIG. 4, with no treating chemical in the reactant accessory or with valve 85 in the down position to prevent adding of the reactant chemical to the flowing water, the wash water is pumped into tub 83, into which has been previously placed about 2 ounces of finely divided (through 100, on 325 mesh sieve) calcium hydroxide powder. The turbulence created by the water entering the tub is sufficient to mix the calcium hydroxide adequately with the waste wash water and produces a copious precipitate of calcium phosphate and other insoluble calcium salts. The production of the precipitate is immediate but the material is allowed to remain in the tub for an additional 10 minutes, to agglomerate the precipitate and help to sorb or trap other constituents of the waste wash water. After that time, the wash water is filtered through a Pur-O-Lator filter of the type illustrated in FIG. 8 and the filtrate is pumped to a sewer, drain or other means of disposal. A filter, with openings of correct sizes to trap the calcium phosphate and other insoluble particles of the waste wash water, is subsequently used with additional treatments of other wash waters and upon being loaded with the phosphate, is cleaned by turning of the scraping blade handle and removal of the bottom plug. The product resulting is burned to remove organic material and the calcium phosphate and other inorganic insolubles are recovered for subsequent use or are discarded. Samples taken of the effluent liquid from the filter show that it contains less than 5 parts per million of phosphates, expressed as elemental phosphorus.

In a modification of the above method, some of the treated phosphate-containing waste wash water is left in the tub, such as about 3 gallons, and the first rinse water is pumped into this. The rinse water contains some phosphate to be treated and the excess calcium hydroxide in the treated waste water in the tub insolubilizes the phosphate in the first rinse. This too, is allowed to stand for a period of time, from 10 minutes to an hour. Then it is filtered and the filtrate is found to contain as little as four or five p.p.m. of phosphorus.

EXAMPLE 2

In a series of experiments like that of Example 1, the same weights of calcium oxide, calcium chloride, alum, aluminum sulfate, aluminum chloride, ferrous chloride and ferric sulfate are used, the detergent employed is a heavy duty laundry detergent of the type described, a low foaming laundry detergent or a cold water laundry detergent, operating temperatures range from 20° C. to 80° C and pH's are from 7 to 10. Charges of detergent are varied from ½ to 2 cups. Yet, under these varied conditions, the copious precipitate of calcium phosphate is still formed and is either discharged directly to the sewer or is filtered, by a plate and frame filter, filter paper, automobile "oil filter", packed glass wool or diatomaceous earth. In all such cases, removal of the insoluble phosphate and other materials is very good and the product resulting is greatly diminished in phosphate content, always containing less than 50 p.p.m. of phosphate, as phosphorus, and in most cases, containing less than 10 p.p.m. thereof. The pH, with the calcium compounds, is preferably kept at about 9 and with the aluminum compounds is maintained about 7.5 by the addition of citric acid.

Similar experiments run with the effluents from dishwashing machines, containing quantities of chlorinated trisodium phosphate, give similarly good results in phosphate reductions in the effluents. Likewise, presoak laundering compositions containing enzymes and phosphates have the soluble phosphates thereof removed by such treatments.

EXAMPLE 3

The experiment of Example 1 is repeated, except for the fact that the apparatus of FIG. 1 is employed. In this operation, the chemical additive is either calcium chloride or aluminum sulfate and the heavy duty laundry detergent concentration is 1.8 g./l. The weight of calcium chloride employed is 60 g. and the aluminum sulfate is used to the extent of 120 g. in the discharged wash water, in both cases at concentrations in the reagent solution of about 40%. The vacuum in the Venturi is about a foot of water and is sufficient to draw the solution out of the bottle into the flowing waste wash water substantially regularly over the period of about two minutes in which the wash water is being pumped from the washing machine. The effluent is pumped directly to the standpipe, without filtration, but when it is filtered, using apparatus like that shown in FIG. 7, the wash water being sewered is found to be very low in phosphate content, containing 0.001%, as $p_2O_5$ in the case of the calcium chloride treatment and 0.025%, when treated with aluminum sulfate. This compares with 0.053%, when untreated. Analyses of the linear tridecyl benzene sulfonate detergent present indicate that this too was diminished to 0.0015% and 0.00062%, respectively, from 0.024%.

Another desirable result of following the procedure of this example is that the content of optical brighteners or fluorescent dyes in the detergent products also is appreciably diminished. It is considered important by some authorities that such materials should not be discharged in large quantities into lakes and rivers and the present method provides a simple means for eliminating them, together with other "undesirable" chemicals. Enzymes and bleaches in the detergents are also either eliminated or reduced manifold by the present procedures.

When the above experiment is repeated with a wide variety of commercial laundry detergent and pre-soak preparations, similar effects are noted, whether hard or soft water is used, e.g., from 25 to 250 p.p.m. hardness, as $CaCO_3$. Especially when combination treatments are employed, either sequentially or jointly, involving the uses of aluminum sulfate, calcium hydroxide and calcium chloride, phosphates are diminished to as little as 1% of their original contents in the waste water and the alkyl aryl sulfonate organic detergent may be cut to 2% of the amount that would be present without treatment. Even better results have been obtained with certain detergents and specific treating agents of. the types described. In some cases, the amount of phosphate present after treatment is so small as to be undetectable and the diminution of alkyl aryl sulfonate is to as little as about 1% of that originally present.

EXAMPLE 4

The procedure of Example 1 is repeated with a wide variety of commercial heavy duty laundry detergent compositions based upon linear higher alkyl benzene sulfonate, olefin sulfonate and lauryl polyethoxy sulfate detergents and sodium tripolyphosphate builder salt, but with a cartridge of calcium hydroxide distributed in glass wool being used, as per FIG. 10. In other cases, instead of the calcium hydroxide, of which about ½ pound is present in the cartridge, together with ½ pound or somewhat less of glass wool, there may be employed calcium carbonate, quicklime or mixtures thereof. When the wash water is passed through the cartridge, it reacts with the calcium hydroxide to produce calcium phosphates or polyphosphates and these, although insoluble, being of small enough particle size to flow through the cartridge, are discharged into the tank 147 and are filtered off by the filter 151. Several tubs of waste wash water are passed through the cartridge and still the content of phosphate, expressed as phosphorus, is below 10 p.p.m. in the effluent.

In the above example, the preceding examples and in the drawing, a pump is sometimes used or is shown after the filter. In some cases, it will be desirable to place this pump upstream of the filter to provide more pressure to force the liquid through the filter, especially when the filter has become nearly full of insoluble material.

EXAMPLE 5

A series of in vitro experiments is run with nine of the best selling commercial heavy duty laundry detergents on the market to determine whether and to what extent phosphates may be removed from them by present treatments. In each case, 1.8 liters of detergent solution in which the detergent is present at a concentration of 0.18% are employed and such solutions are treated with solutions or dispersions of aluminum sulfate, calcium hydroxide, calcium chloride, aluminum chloride, calcium oxide, ferric or ferrous chloride, or mixtures thereof. The amount of treating chemicals employed varies from 1 to 3 g./l. In some cases, aluminum sulfate is used, followed by calcium hydroxide. In other cases, calcium chloride is mixed with aluminum sulfate and is employed. In still other experiments aluminum sulfate is mixed with calcium carbonate. In most of the experiments, the individual treating chemicals are employed alone.

The results of the great number of tests run show that phosphate content, as $P_2O_5$, is diminished from about 0.05% to from 0.0002% to 0.03% and on the average appears to be cut to about 0.001%. Similarly, the alkyl aryl sulfonate contents are decreased from about 0.02% to from 0.0003% to 0.005%, with the average being about 0.001%

The results of such experiments are further confirmed by in vivo testing, utilizing washing machine effluents from the normal laundering of dirty clothing and textiles.

The invention has been described with respect to working examples and drawings showing its operation and the results thereof. It is not to be considered as limited to the specific embodiments given vecause it is evident that equivalents may be substituted for elements of the invention without going beyond its scope or varying from its principles.

What is claimed is:

1. A method of washing items with detergent containing soluble phosphate which comprises contacting in a tub means, the items to be washed with washing solution containing such detergent and, after completion of washing, removing the washing solution from the washed items, conveying said washing solution to a conduit running from said tub means to a sewer, drain or other means of disposal, supplying a suitable reactive chemical compound to said washing solution in said conduit, reacting the soluble phosphate in the washing solution with said reactive chemical compound in said conduit before discharge of the washing solution to said sewer drain or other means of disposal, so as to convert the soluble phosphate to insoluble form, said supplying step being effected by providing a Venturi section in said conduit for dispensing said reactive chemical compound and conveying said washing solution at a sufficient rate to create a vacuum in said Venturi section that draws a sufficient quantity of said reactive chemical compound into said washing solution, said reacting step being effected by the continuous addition to said washing solution from said Venturi section of from a stoichiometric proportion to a 200% excess, based on the soluble phosphate content of the removed washing solution, of a suitable precipitant salt chosen from the group consisting of oxides, hydroxides and soluble salts of calcium, aluminum and iron in an aqueous medium at a concentration of about 2 to about 80 weight percent to insolubilize substantially all of said phosphate.

2. A method according to claim 1 wherein, after reaction of the compound and the soluble phosphate to produce insoluble phosphate, the insoluble phosphate is removed from the used washing solution by filtration or other separatory method and the washing solution, free of phosphate or of substantially lower phosphate content than when discharged from the washing machine or dishwasher, is then discharged to a sewer, drain or other means of disposal.

3. A method according to claim 2 wherein the soluble phosphate is an alkali metal pyrophosphate, tripolyphosphate or orthophosphate, the reactive chemical compound is an at least slightly water soluble compound of a metal which forms an insoluble phosphate or polyphosphate, and the chemical reaction and filtration operations take place at or near the location at which the items are washed.

4. A method according to claim 3 wherein the items being washed are laundry, washing is effected in an automatic washing machine, the reactive chemical is an oxide, hydroxide or soluble salt of calcium, aluminum or iron in an aqueous medium, at a concentration of about 2 to 80%, so as to convert substantially all the soluble phosphate to insoluble phosphate and to remove from 75 to 100% thereof from the waste wash water being discharged.

5. A method according to claim 4 wherein the washing solution comprises synthetic organic detergent of the anionic and/or nonionic type with pentasodium tripolyphosphate builder, the reaction between the chemical compound and the soluble phosphate in the wash water being discharged is at a temperature of about 15° to 80° C., the time of reaction is from 1 second to 1 hour and the wash water discharged after filtration contains less than 10 parts per million of phosphorus in water soluble form.

* * * * *